US006371680B1

(12) United States Patent
Webb

(10) Patent No.: US 6,371,680 B1
(45) Date of Patent: Apr. 16, 2002

(54) DIVIDER MEANS

(75) Inventor: Hugh Webb, London (GB)

(73) Assignee: Folders Galore Limited, London (GB)

( * ) Notice: Subject to any disclaimer, the term of this patent is extended or adjusted under 35 U.S.C. 154(b) by 0 days.

(21) Appl. No.: 09/634,891

(22) Filed: Aug. 7, 2000

(30) Foreign Application Priority Data

Aug. 13, 1999 (GB) ..... 9919250

(51) Int. Cl.[7] ..... B42F 13/00

(52) U.S. Cl. ..... 402/79; 281/42; 283/36; 283/37

(58) Field of Search ..... 402/79, 4, 80 R, 402/80 P; 281/42, 38, 15.1, 51; 283/36–42; 116/234, 235, 239, 240

(56) References Cited

U.S. PATENT DOCUMENTS

| | | | | | |
|---|---|---|---|---|---|
| 3,719,161 | A | * | 3/1973 | Wegner | 402/79 |
| 5,876,145 | A | * | 3/1999 | Datum | 402/79 X |
| 5,947,525 | A | * | 9/1999 | Pollman | 402/79 X |

FOREIGN PATENT DOCUMENTS

| | | |
|---|---|---|
| AR | 270056 | 1/1950 |
| DE | 196 47 267 | 5/1998 |

* cited by examiner

*Primary Examiner*—Willmon Fridie, Jr.
(74) *Attorney, Agent, or Firm*—Clark & Brody

(57) ABSTRACT

Divider means for dividing a set of pages, especially but not exclusively in a binder, into groups of pages. The divider means comprise a single sheet of material which is cut into a plurality of divider portions of the sheet, each extending from a common connecting portion of the sheet.

11 Claims, 6 Drawing Sheets

DIVIDER MEANS

TECHNICAL FIELD

The present invention relates to divider means for dividing a set of pages, especially but not exclusively in a binder, into groups of pages.

BACKGROUND OF THE INVENTION

Hitherto, such divider means for a loose-leaf folder with a ring binding mechanism have comprised a set of separate sheets, each having holes punched through them along an intended inner edge thereof to enable them to be secured to the mechanism, and a tab along an opposite edge to protrude beyond the adjacent edges of the pages held in the folder. This enables a selected group of pages within the folder to be quickly accessed simply by grasping the relevant tab and lifting it along with the divider, of which it forms a part.

A disadvantage of such divider means is the relative expense, especially bearing in mind that each sheet needs to be relatively strong and therefore thick so that it will not wear too quickly with frequent use. It is also less easy to have such divider means retained in the folder regardless of whether all the sheets are in use or not.

SUMMARY OF THE INVENTION

The present invention seeks to obviate one or more of these disadvantages.

Accordingly, the present invention is directed to divider means for dividing a set of pages, especially but not exclusively in a binder, into groups of pages, comprising a single sheet of material which is cut into a plurality of divider portions of the sheet, each extending from a common connecting portion of the sheet.

Advantageously, to reduce wastage of sheet material, divider portions may be contiguous, severed from one another by a single cut which terminates in the sheet at one side of the common connecting portion.

Preferably, the divider portions comprise a plurality of strips or fingers. This provides an efficient use of the sheet material.

The common connection portion may be provided with holes at opposite ends thereof to enable rivets of a binder mechanism to be inserted therethrough. Alternatively, recesses may be formed in the boundary of the common connection portion of the sheet to accommodate such rivets whilst enabling a part of the common connecting portion of the sheet to be inserted between a binding mechanism and a folder to which it is already attached.

Alternatively, the common connecting portion may be provided with holes through which respective ring portions of the rings of a binding mechanism can be threaded.

Alternatively, the common connecting portion of the sheet can be provided with slots to enable respective unopened rings of a ring binding mechanism to be inserted therethrough.

Score or crease lines may be formed in the sheet to facilitate folding over of one or more of the dividing portions. The score or crease lines may be in the proximal ends of the divider portions. Alternatively, they may be located in the common connecting portion adjacent to the divider portions.

The present invention extends to a binder comprising a folder, a binding mechanism secured thereto, and divider means for dividing a set of pages held in the binding mechanism when the binder is in use into groups of pages, the divider means comprising a single sheet of material which is cut into a plurality of divider portions of the sheet, each extending from a common connecting portion of the sheet.

BRIEF DESCRIPTION OF THE DRAWING

Examples of divider means made in accordance with the present invention will now be described in greater detail with reference to the accompanying drawings, in which.

DETAILED DESCRIPTION OF THE PREFERRED EMBODIMENTS

Figure 1:
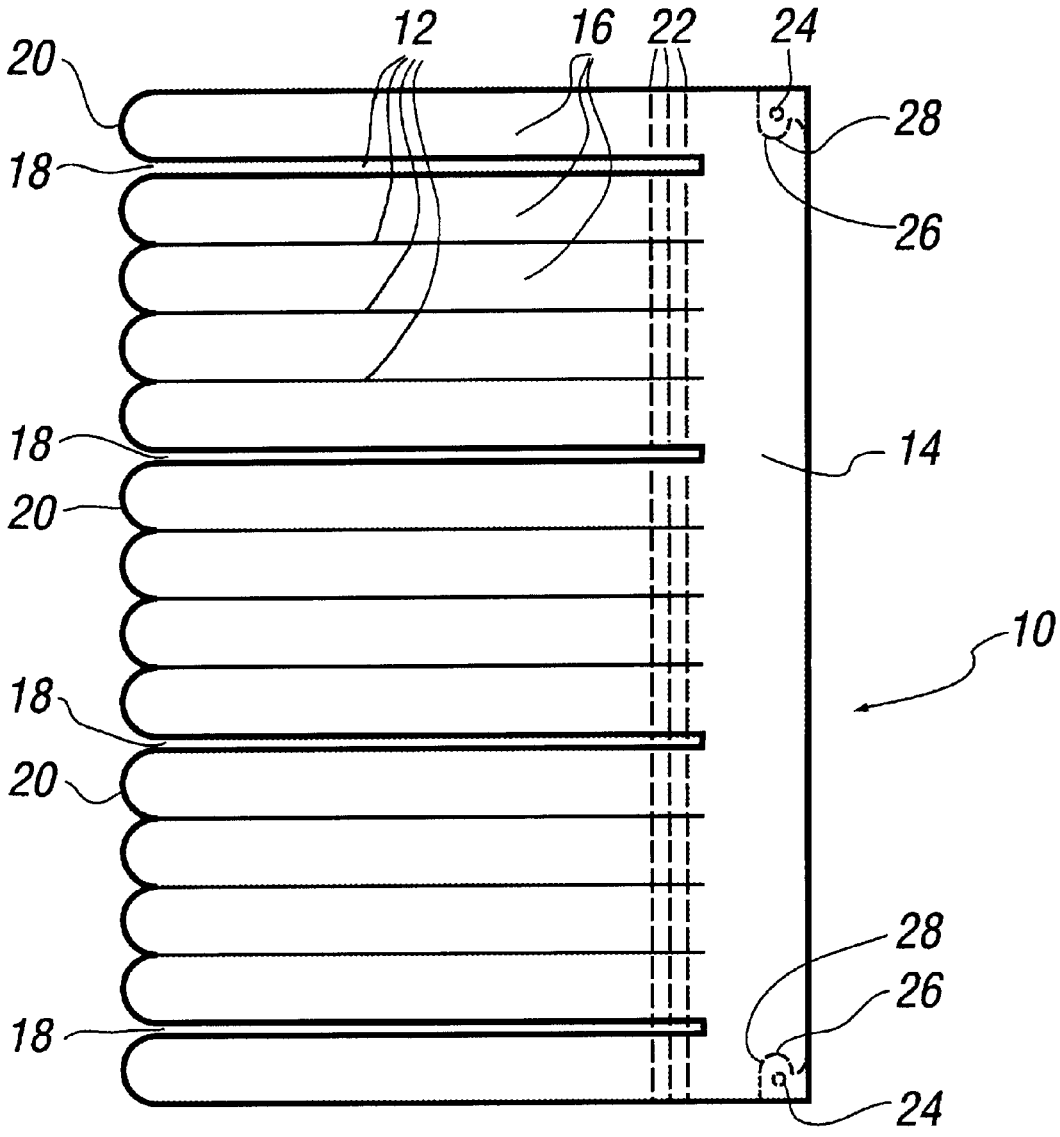
FIG. 1 shows a plan view of a first such example.

The divider means 10 shown in FIG. 1 comprises a sheet of thin polypropylene of a thickness of about 300 $\mu$m, a width slightly less than that of A4 paper and a height substantially the same as that of A4 paper. A plurality of cuts 12 extend inwardly from the left-hand side of the sheet as shown in FIG. 1, horizontally towards the right-hand side of the sheet, but terminate before reaching that edge to leave a margin of the sheet constituting a common connecting portion 14 thereof. The series of cuts 12 are uniformly spaced apart to define strips or fingers 16. Four of the cuts 12 and also labelled 18 have a significant width greater than the cross-section of the ring of a ring binding mechanism. In the divider means illustrated in FIG. 1, there are four such gaps 18 intended to be in registration with four rings respectively of a ring binding mechanism when the divider means are in use.

Otherwise, adjacent strips or fingers 16 are contiguous with one another being severed only by the relevant cut 12.

The distal ends 20 of the stips or fingers 16 are rounded.

Score or crease lines 22 extend across the fingers all the way from the top of the divider means 10 to the bottom thereof running parallel to the common connecting portion 14, to enable each strip or finger 16 to be folded over independently of the others.

The sheet is provided with two holes 24 close to the upper and lower right-hand corners of the sheet respectively. These are rivet holes. Alternatively, the top and bottom right-hand corners of the sheet can be cut off by cuts shaped as indicated by the broken lines 26. Each of these provides a recess 28 in the edge of the sheet material which can accommodate rivets of a ring binder mechanism already secured to a folder.

Figure 2:
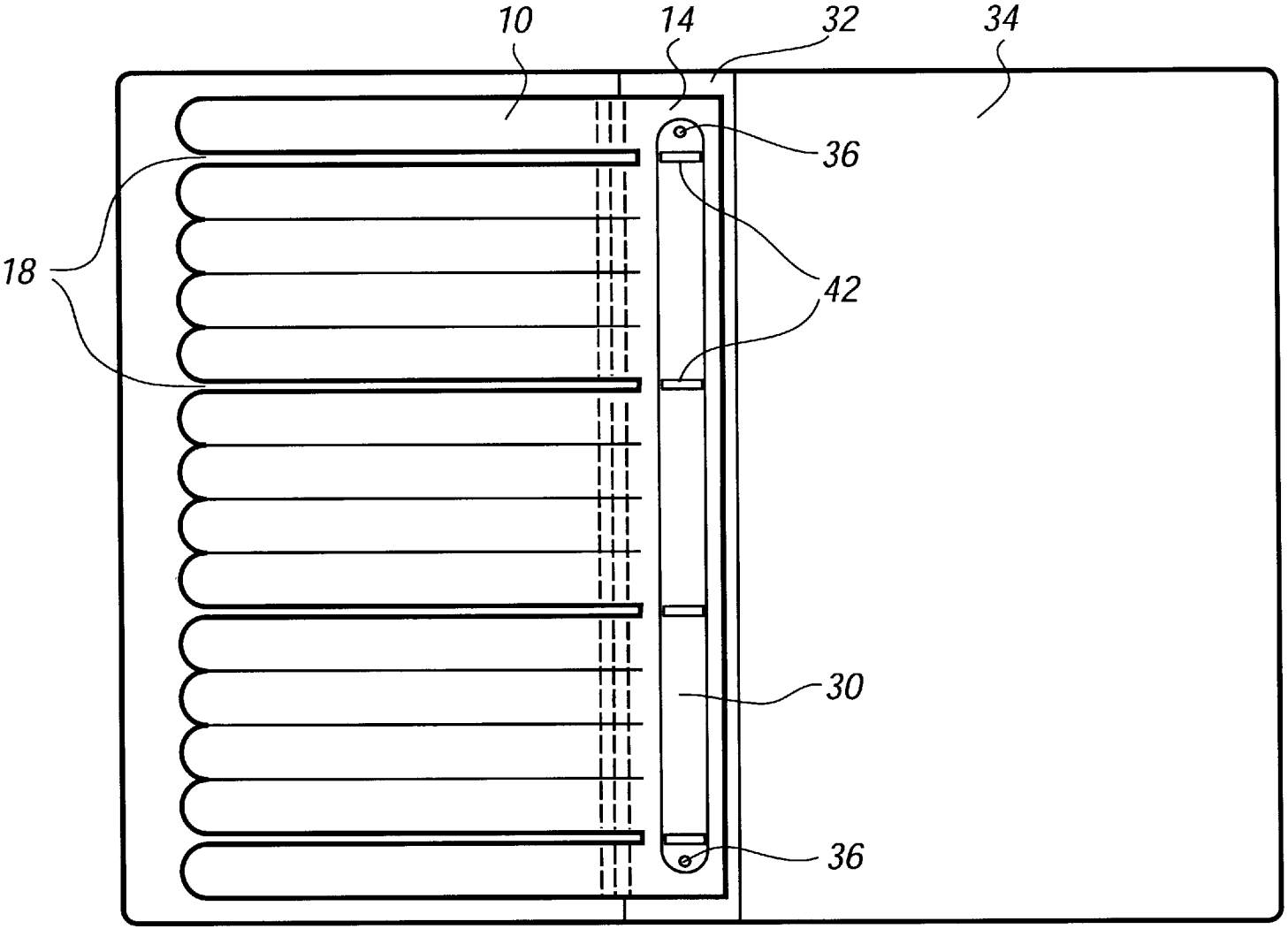
FIG. 2 shows a plan view of an open folder provided with a ring binder mechanism, with a common connection portion of the divider means shown in FIG. 1 sandwiched between the mechanism and the folder.
Figure 3:
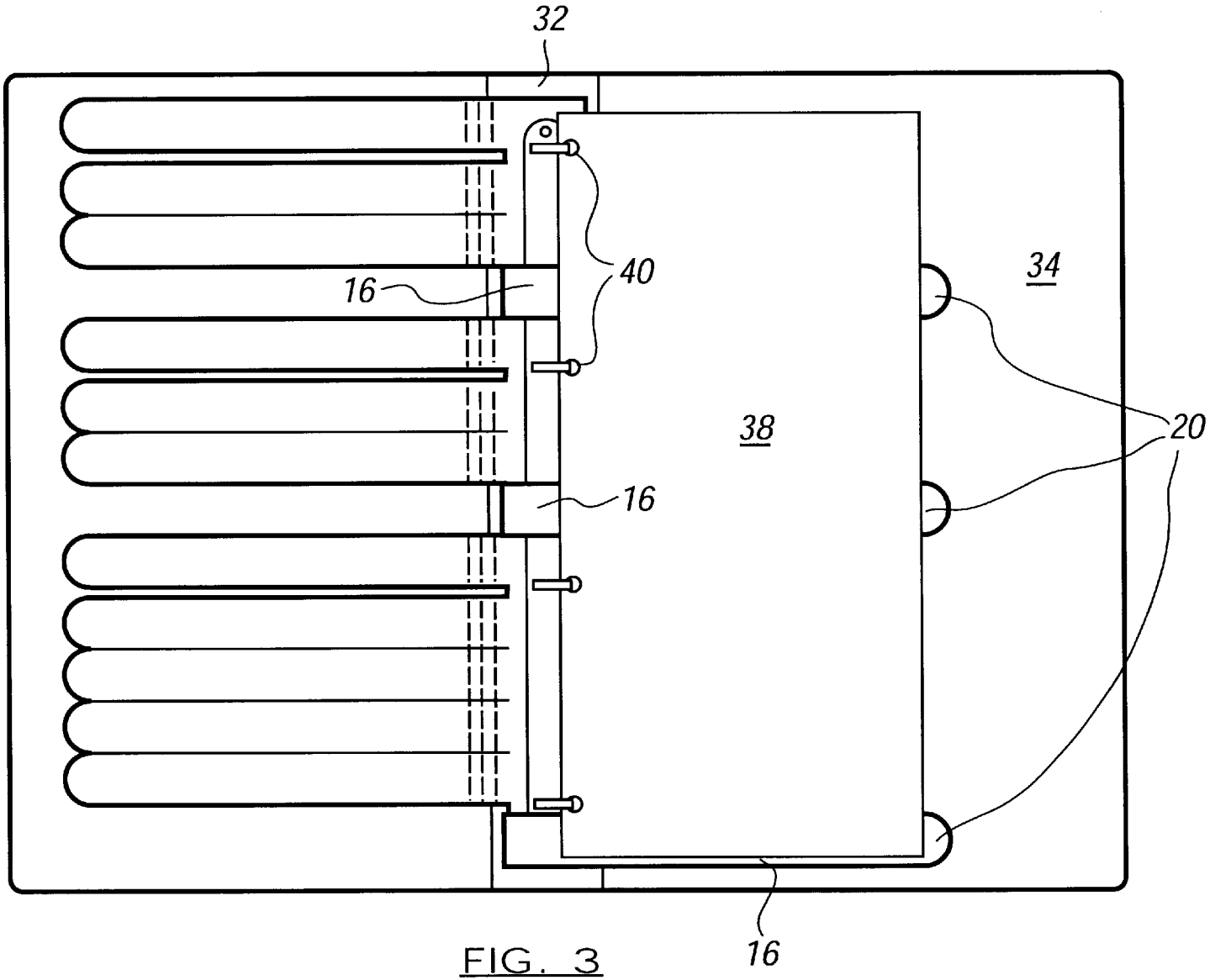
FIG. 3 shows a further plan view of the open folder shown in FIG. 2 with pages held by the ring binding mechanism; and three divider portions of the dividing means shown in FIGS. 1 and 2 folded over and inserted between adjacent pages.

When in use, the divider means shown in FIG. 1 has its common connecting portion 14 sandwiched between a ring binder mechanism 30 and the spine 32 of a folder 34 to which the ring binder 30 is riveted by rivets 36. These pass through the holes 24 in the divider means 10. When a multiplicity of pages 38 each having holes 40 punched therein to enable the pages to be fastened in the ring binder mechanism 30, these pages 38 may be divided into groups of pages by the divider means 10. Pages 38 intended to be above a given strip or finger 16 are removed, and then that strip or finger 16 is folded over from the left-hand side of the folder as shown in FIGS. 2 and 3 on to the pages 38 on the right-hand side as shown in FIG. 3, the removed pages 38 then being re-secured on top of the strip or finger 16. In FIG. 3, two further strips or fingers 16 have been folded over in this way to divide the pages in the folder into four groups altogether. As is evident from FIG. 3, the end 20 of the strips or fingers 16 protrude beyond the outer edges of the pages 38. This enables the relevant group of pages 38 to be accessed simply by lifting the appropriate end 20.

Alternatively, each strip or finger 16 may be threaded in between two adjacent pages 38 at the desired position in the stack, without removing any pages from the ring binding mechanism.

Figure 4:
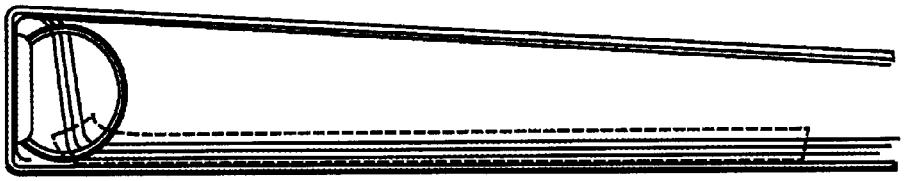
FIG. 4 shows an end view of the folder shown in FIG. 3 after it has been closed.

The end view shown in FIG. 4 is the lower end of the folder shown in FIG. 3 after the latter has been closed. It can be seen from this that the folder can be opened and any number of the sheets 38 turned over from one side of the folder to the other without being obstructed in any way by the strips or fingers 16.

As is evident from FIGS. 2 and 3, the gaps 18 are generally located in registration with the rings 42 of the binding mechanism 30.

Figure 5:
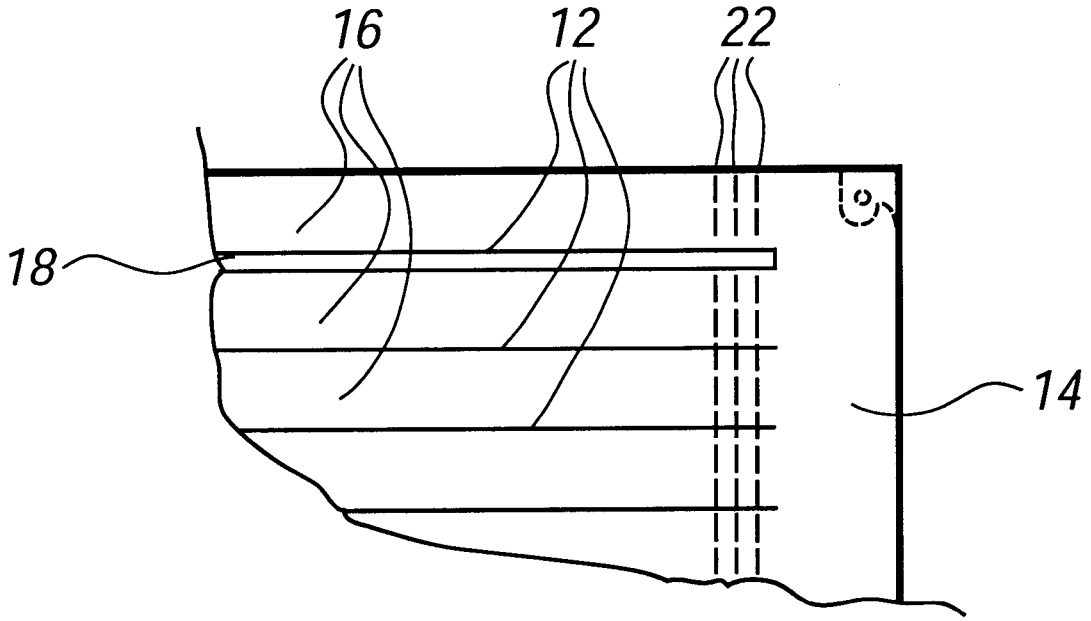
FIGS. 5, 6 and 7 show top right-hand corner portions of modified forms of divider means.

In a modified form of divider means shown in FIG. 5, the common connecting portion 14 is wider, and the score or crease lines 22 are located on the common connecting portion adjacent to the ends of the cuts 12. This enables all of the strips or fingers 16 to be folded over, selective ones being placed between the pages held in the folder.

Figure 6:
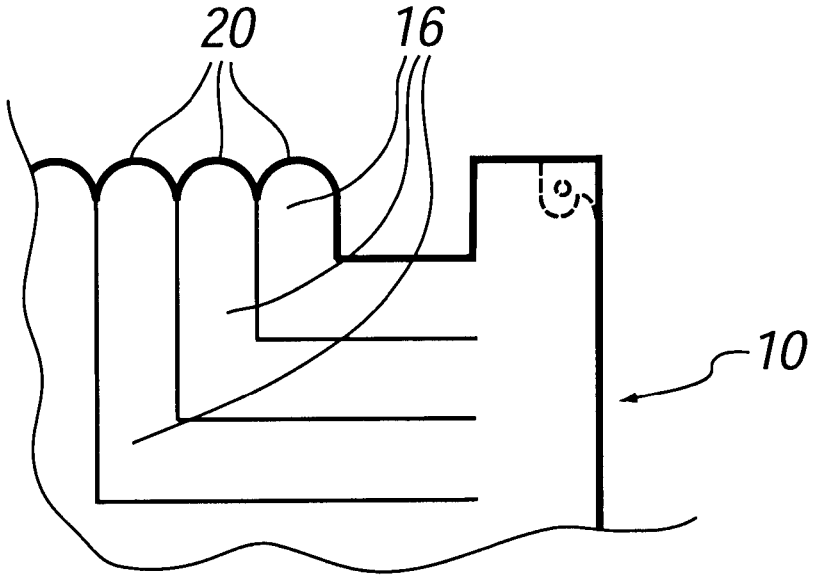

In the modification shown in FIG. 6, each strip or finger 16 is L-shaped so that the rounded ends 20 thereof are located along an upper edge of the divider means 10.

Figure 7:
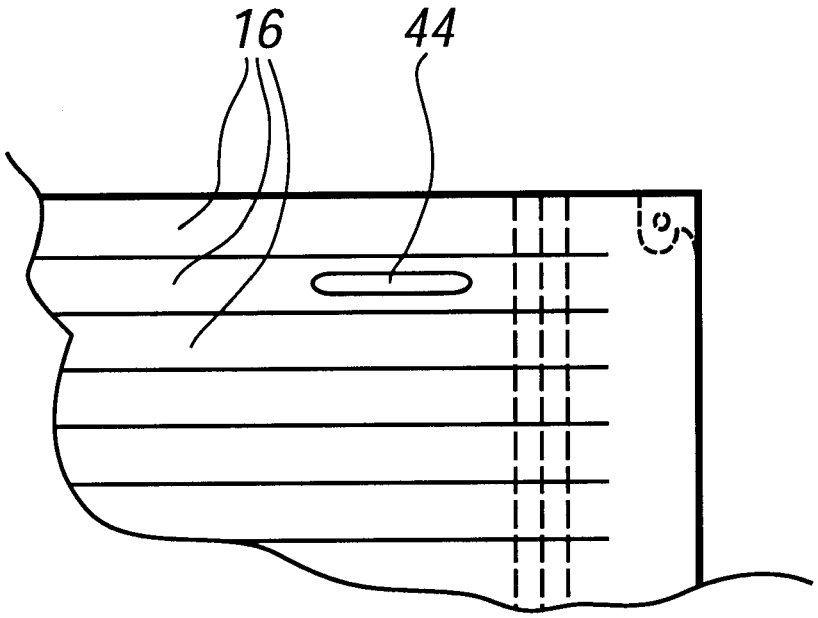

In FIG. 7, the gaps 18 are omitted, and each divider 16 which would, when folded over, engage a ring of the ring binder mechanism, is provided with a slot 44 to enable the ring to pass therethrough.

Figure 8:
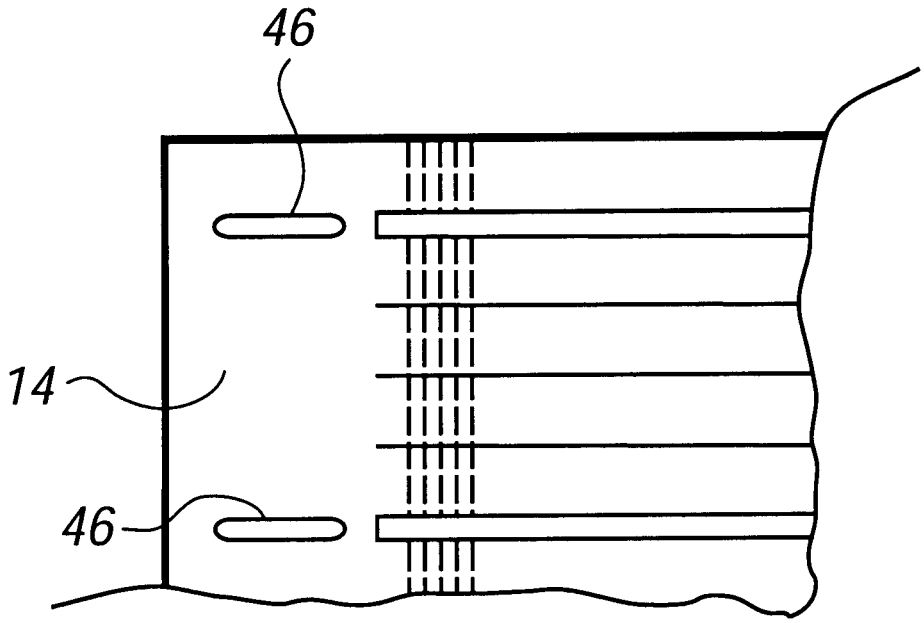
FIGS. 8 and 9 show respective upper left-hand corners of further modified forms of divider means.

In the embodiment of the present invention shown in FIG. 8, slots 46 are provided in the common connecting portion 14 to enable the divider means to be attached to the ring binder mechanism by inserting the unopened rings through the holes 46 respectively.

Figure 9:
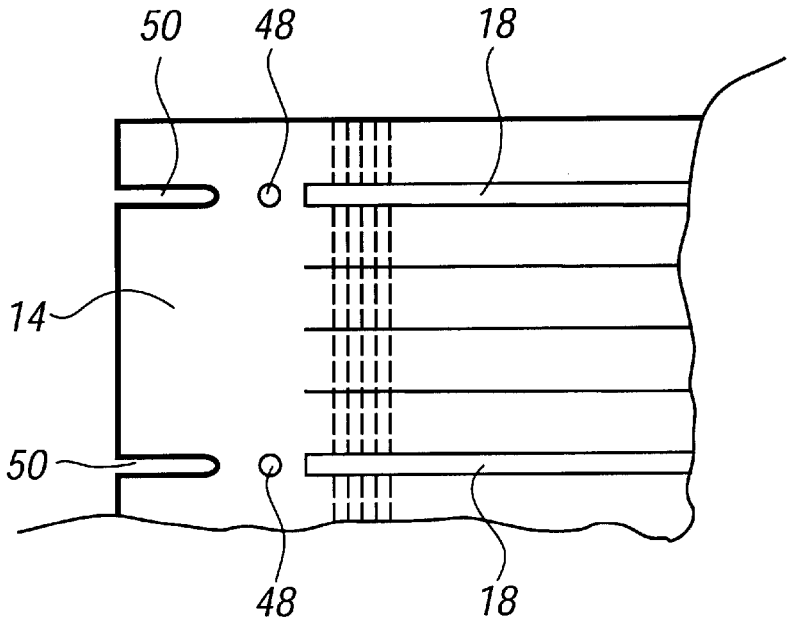
Figure 10:
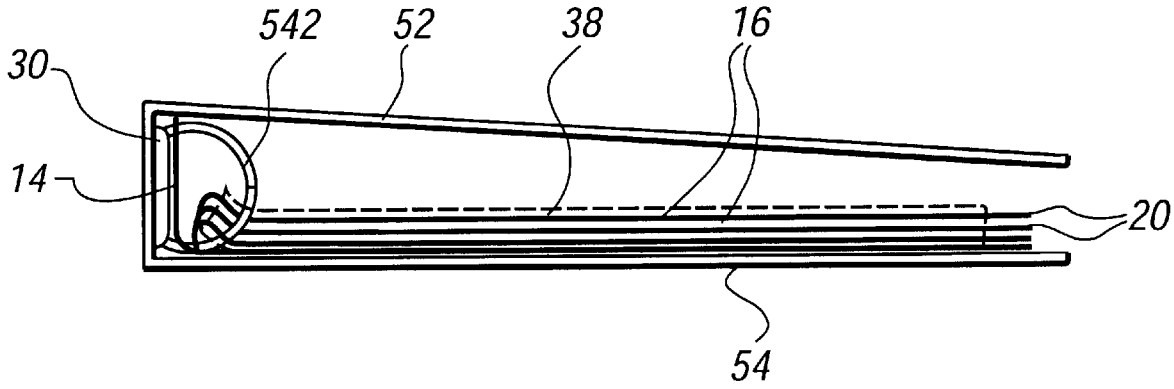
FIG. 10 shows a bottom end view of a folder with a ring binding mechanism, and a divider means as shown in FIG. 9.

In the embodiment shown in FIG. 9, circular holes 48 are provided adjacent to the end of each gap 18, and open slots 50 are cut in from the adjacent side of the sheet towards each hole 48 and in registration therewith. Each ring may then have one of its ring portions threaded through the hole 48 and the other passing through the slot 50. When this embodiment of the invention is in use, it takes the form shown in FIG. 10. It will be seen that the common connecting portion 14 has its free edge adjacent to the cover flap 52 of the folder 34. Each divider portion then extends from a position adjacent to the rear flap 54 of the folder 34 inwardly to a position within the ring region defined by the rings 42 of the ring binder mechanism 30 and then in between the pages 38, at the inner edges thereof so that the ends 20 of the strips or fingers 16 protrude outwardly beyond the outer ends of the pages 38.

The thickness of the divider means 10 may be from 150 $\mu$m to 1,000 $\mu$m thick, whether it is made of polypropylene or rigid or flexible polyvinyl chloride. Alternatively, it may be made of laminated card with a thickness of about 400 $\mu$m.

The divider means 10 may be secured to the ring binding mechanism and/or the folder, alternatively, by gluing, welding or with its own rivets, or via a further strip of material or a pocket.

The strips or fingers 16 may be all the same length, or of varying length on the same divider means 10.

More than one divider means 10 may be secured to the same binder, each dividing means 10 having strips or fingers 16 of the same or of different length.

The divider means 10 may be used with binding mechanisms other than ring binding mechanisms, and indeed may even comprise simply a book-mark.

The divider means 10 may be designed as a universal fit for any binding mechanism.

I claim:

1. A divider for dividing a set of pages, especially but not exclusively in a binder, into groups of pages, the divider comprising a single sheet of material formed into a plurality of divider portions of the sheet, each of said divider portions extending from a common connecting portion of the sheet and being separated from other of said divider portions by at least one cut that extends inwardly from one side of the sheet towards the other side of the sheet but terminates before reaching the edge of said other side to leave a margin of the sheet constituting the said common connecting portion.

2. A divider according to claim 1, in which the divider portions are immediately adjacent to one another and severed from one another by the said at least one cut.

3. A divider according to claim 1, in which the divider portions comprise a plurality of strips or fingers.

4. A divider according to claim 1, in which the common connection portion is provided with holes at opposite ends thereof to enable rivets of a binder mechanism to be inserted therethrough.

5. A divider according to claim 1, in which recesses are formed in the boundary of the common connection portion of the sheet to accommodate rivets of a binder mechanism whilst enabling a part of the common connecting portion of the sheet to be inserted between the mechanism and a folder to which it is already attached.

6. A divider according to claim 1, in which the common connecting portion is provided with holes through which respective ring portions of the rings of a binding mechanism can be threaded.

7. A divider according to claim 1, in which the common connecting portion of the sheet is provided with slots to enable respective unopened rings of a ring binding mechanism to be inserted therethrough.

8. A divider according to claim 1, in which score or crease lines are formed in the sheet to facilitate folding over of one or more of the divider portions.

9. A divider according to claim 8, in which the score or crease lines are in the proximal ends of the divider portions.

10. A divider according to claim 8, in which the score or crease lines are located in the common connecting portion adjacent to the divider portions.

11. A binder comprising a folder, a binding mechanism secured thereto, and a divider for dividing a set of pages held in the binding mechanism when the binder is in use into groups of pages, in which the divider comprises a single sheet of material which is formed into a plurality of divider portions of the sheet, each of said divider portions extending from a common connecting portion of the sheet and being separated from other of said divider portions by at least one cut that extends inwardly from one side of the sheet towards the other side of the sheet but terminates before reaching the edge of said other side to leave a margin of the sheet constituting the said common connecting portion.

* * * * *